US008616193B2

(12) United States Patent
Padgett

(10) Patent No.: US 8,616,193 B2
(45) Date of Patent: Dec. 31, 2013

(54) COOKTOP SWIRL BURNER

(75) Inventor: Michael Padgett, Austin, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 666 days.

(21) Appl. No.: 12/147,656

(22) Filed: Jun. 27, 2008

(65) Prior Publication Data

US 2009/0320823 A1 Dec. 31, 2009

(51) Int. Cl.

| | |
|---|---|
| ***F24C 3/00*** | (2006.01) |
| ***F24C 3/08*** | (2006.01) |
| ***F23C 5/00*** | (2006.01) |
| ***F23M 3/00*** | (2006.01) |
| ***F23D 14/62*** | (2006.01) |

(52) U.S. Cl.

USPC ..... 126/39 E; 126/39 R; 431/8; 431/9; 431/354

(58) Field of Classification Search

USPC ..... 431/9, 8, 354; 126/39 R, 39 E

See application file for complete search history.

(56) References Cited

U.S. PATENT DOCUMENTS

| | | | | |
|---|---|---|---|---|
| 2,402,971 | A | 7/1946 | McCollum | |
| 2,452,779 | A | 11/1948 | McCollum | |
| 3,220,460 | A | 11/1965 | Goubsky et al. | |
| 3,746,499 | A | 7/1973 | Guerre et al. | |
| 3,922,137 | A | 11/1975 | Peczeli et al. | |
| 4,155,701 | A | 5/1979 | Primas | |
| 4,351,632 | A | 9/1982 | Nagai | |
| 4,373,896 | A | 2/1983 | Zwick et al. | |
| 4,374,637 | A * | 2/1983 | Zwick et al. | 431/183 |
| 4,639,212 | A | 1/1987 | Watanabe et al. | |
| 4,969,815 | A | 11/1990 | Fukuda et al. | |
| 4,971,551 | A | 11/1990 | Fukuda et al. | |
| 4,971,552 | A | 11/1990 | Fukuda et al. | |
| 4,971,553 | A | 11/1990 | Fukuda et al. | |
| 4,993,939 | A | 2/1991 | Fukuda et al. | |
| 5,000,679 | A | 3/1991 | Fukuda et al. | |
| 5,277,578 | A | 1/1994 | Ratnani et al. | |
| 5,437,262 | A | 8/1995 | George, II et al. | |
| 5,649,822 | A * | 7/1997 | Gertler et al. | 431/354 |
| 6,132,205 | A * | 10/2000 | Harneit | 431/354 |
| 6,325,619 | B2 | 12/2001 | Dane | |
| 7,083,123 | B2 | 8/2006 | Molla | |
| 7,614,877 | B2 * | 11/2009 | McCrorey et al. | 431/354 |
| 2003/0022123 | A1 * | 1/2003 | Wolf et al. | 431/354 |
| 2004/0195399 | A1 | 10/2004 | Molla | |
| 2007/0224562 | A1 | 9/2007 | Hiromitsu et al. | |

FOREIGN PATENT DOCUMENTS

| | | | | |
|---|---|---|---|---|
| CN | 1479044 | | 3/2004 | |
| EP | 1431658 | | 6/2004 | |
| EP | 1512908 | | 3/2005 | |
| GB | 2256268 | A * | 12/1992 | F24C 3/08 |
| JP | 2004053114 | A * | 2/2004 | F23D 14/02 |
| JP | 2006138595 | | 6/2006 | |

OTHER PUBLICATIONS

International Search Report for PCT/US2009/047491 dated Apr. 4, 2012, 3 pages.

* cited by examiner

*Primary Examiner* — Kenneth Rinehart
*Assistant Examiner* — William Corboy
(74) *Attorney, Agent, or Firm* — Pearne & Gordon LLP

(57) ABSTRACT

A gas burner for a cooking appliance is described. The gas burner includes a burner with an inner and outer wall positioned on a burner base, and a circular combustion chamber. The burner includes a plurality of angled fuel exit ports in the inner wall that swirl gaseous fuel into the combustion chamber. The burner also includes vanes on the base of the burner that swirl air drawn into the burner by convection.

16 Claims, 9 Drawing Sheets

COOKTOP SWIRL BURNER

BACKGROUND OF THE INVENTION

The invention generally relates to gas burner devices used in home and commercial range-top stove applications. More particularly, the invention relates to burners in which the fuel and air are swirled and the flames converge towards a heat concentration point to provide improved heating of a cooking vessel.

Traditional gas burners for cook tops and stoves are so-called "external flame" gas burners in which the flames extend radially outwards from the burner during operation. These burners provide satisfactory performance, and typically provide a heat transfer efficiency of about 30-40% to a cooking vessel resting on a grate over the burner.

One of the techniques used to provide more efficient combustion is to cause the fuel/air mixture to undergo a swirling motion at the time of ignition. One such burner apparatus is disclosed in U.S. Pat. No. 5,437,262, which describes a burner in which premixed gaseous fuel and air is directed into a combustion chamber, swirled, and then ignited in order to heat a cooking vessel by a combination of conductive and radiative heat transfer.

More recently, burners of the so-called "internal flame" type have been developed in which the flames converge towards a central point. See for example U.S. Pat. No. 7,083,123, which describes a laterally mountable internal flame burner that includes a venturi tube to help provide sufficient air for combustion.

However, while these types of burners provide increased burner capabilities in terms of dynamic power range, energy efficiency, and heat-loss reduction, there remains room for improvement of burner design in terms of burner performance, as well as other aspects such as convenience of use and resistance to spillage.

SUMMARY OF THE INVENTION

In accordance with one aspect of the present invention, the invention provides a gas burner for a cooking appliance that includes a burner with a burner base, an inner wall, and an outer wall, wherein the burner base includes a first side, a second side, and a hollow circular combustion chamber in the center of the burner base, the inner wall being positioned on the first side of the burner base along the circular center region, and the outer wall being positioned on the first side of the burner base outwards from the inner wall, forming an annular fuel/air channel between the inner wall and the outer wall; a plurality of aligned angled fuel exit ports in the inner wall; and a plurality of vanes with a first end and a second end, angled in the same direction as the fuel exit ports, wherein the first end is positioned on the second side of the burner base and the second end extends beyond the inner wall and adjacent to the combustion chamber.

In accordance with another aspect of the present invention, the invention provides a gas burner for a cooking appliance that includes a burner with a burner base, an inner wall, and an outer wall, wherein the burner base comprises a first side, a second side, and a hollow circular combustion chamber in the center of the burner base, the inner wall being positioned on the first side of the burner base along the combustion chamber, and the outer wall being positioned on the first side of the burner base outwards from the inner wall, forming an annular fuel/air channel between the inner wall and the outer wall; a plurality of angled fuel exit ports include grooves in the top of the inner wall that form a portion of a spiral pattern; a plurality of curved vanes with a first end and a second end that form a portion of a spiral pattern aligned with that created by the fuel exit ports, wherein the first end is positioned on the second side of the burner base and the second end extends beyond the inner wall and adjacent to the combustion chamber; two gas entry holes positioned opposite from one another within the annular fuel/air channel, and two gas entry tubes connected to the gas entry holes and extending from the second side of the burner base; an annular burner cap configured to fit over the annular fuel/air channel; and a mounting base with a substantially C-shaped structure including a securing plate and two supporting brackets, wherein the securing plate comprises two gas tube apertures that are positioned and sized to receive the gas entry tubes and aligned with a gas line entry port in a support bracket and an igniter aperture positioned and sized to retain an igniter within the combustion chamber of the burner.

In accordance with another aspect of the present invention, the invention provides a gas burner for a cooking appliance that includes a burner with a burner base having a first side, a second side, and a hollow circular combustion chamber in the center of the burner base, a wall being positioned on the first side of the burner base, the wall having one or more fuel exit ports; and a plurality of vanes with a first end and a second end, angled in the same direction relative to the combustion chamber, wherein the first end is positioned on the second side of the burner base and the second end extends beyond the wall and adjacent to the combustion chamber.

Unless otherwise specified, "a," "an," "the," and "at least one" are used interchangeably and mean one or more than one. Also herein, the recitations of numerical ranges by endpoints include all numbers subsumed within that range (e.g., 1 to 5 includes 1, 1.5, 2, 2.75, 3, 3.80, 4, 5, etc.). It is understood that all spatial references, such as "horizontal," "vertical," "top," "upper," "lower," "bottom," "left," and "right," are for illustrative purposes only and can be varied within the scope of the disclosure.

The above summary of the present invention is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

Figure 1:
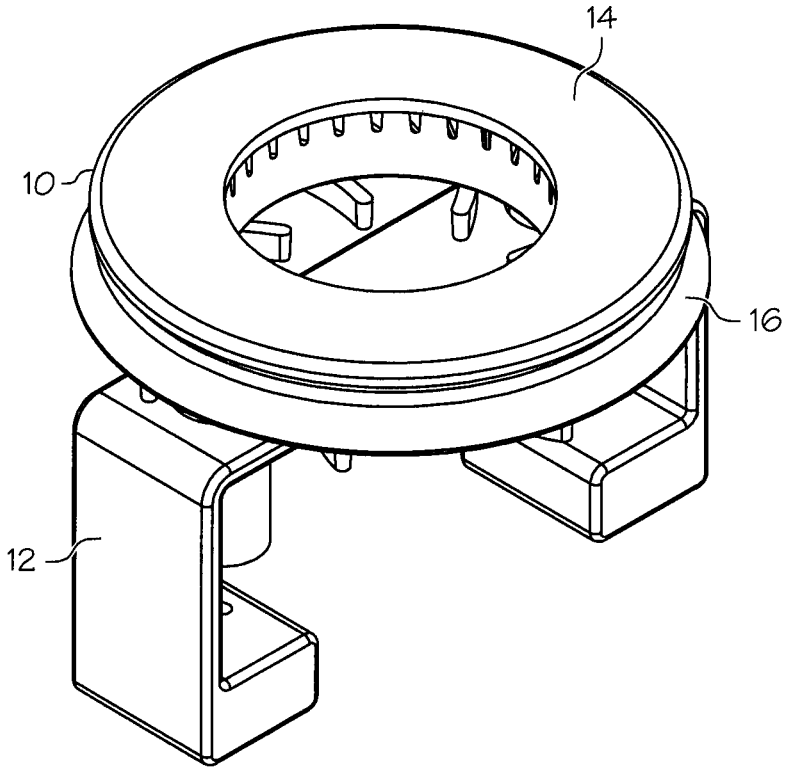
FIG. 1 provides a top perspective view of a gas burner positioned atop a mounting base.

The following detailed description is to be read with reference to the figures, in which like elements in different figures have like reference numerals. The figures, which are not necessarily to scale, depict selected embodiments and are not intended to limit the scope of the invention. Skilled artisans will recognize the embodiments provided herein have many useful alternatives that fall within the scope of the invention.

DETAILED DESCRIPTION OF EMBODIMENTS OF THE INVENTION

The following discussion is presented to enable a person skilled in the art to make and use the invention. Various modifications will be readily apparent to those skilled in the art, and the general principles disclosed herein may be applied to other embodiments and applications without departing from the scope of the present invention as defined by the appended claims. Thus, the present invention is not intended to be limited to the embodiments shown, but is to be accorded the widest scope consistent with the principles and features disclosed herein.

The present invention relates to a gas burner for a cooking appliance. An embodiment of the invention is shown in FIG. 1, which provides a top perspective view of a gas burner 10 positioned atop a mounting base 12. The mounting base 12 positions the gas burner 10 on a cooktop, and aligns the gas burner 10 with the gas lines and igniter that are used during operation of the gas burner 10. The gas burner 10 provides a structure that mixes gaseous fuel with air to create a combustible mixture. Preferably, the gas burner 10 mixes the gaseous fuel and the air fairly evenly to provide hot and efficient combustion.

Figure 2:
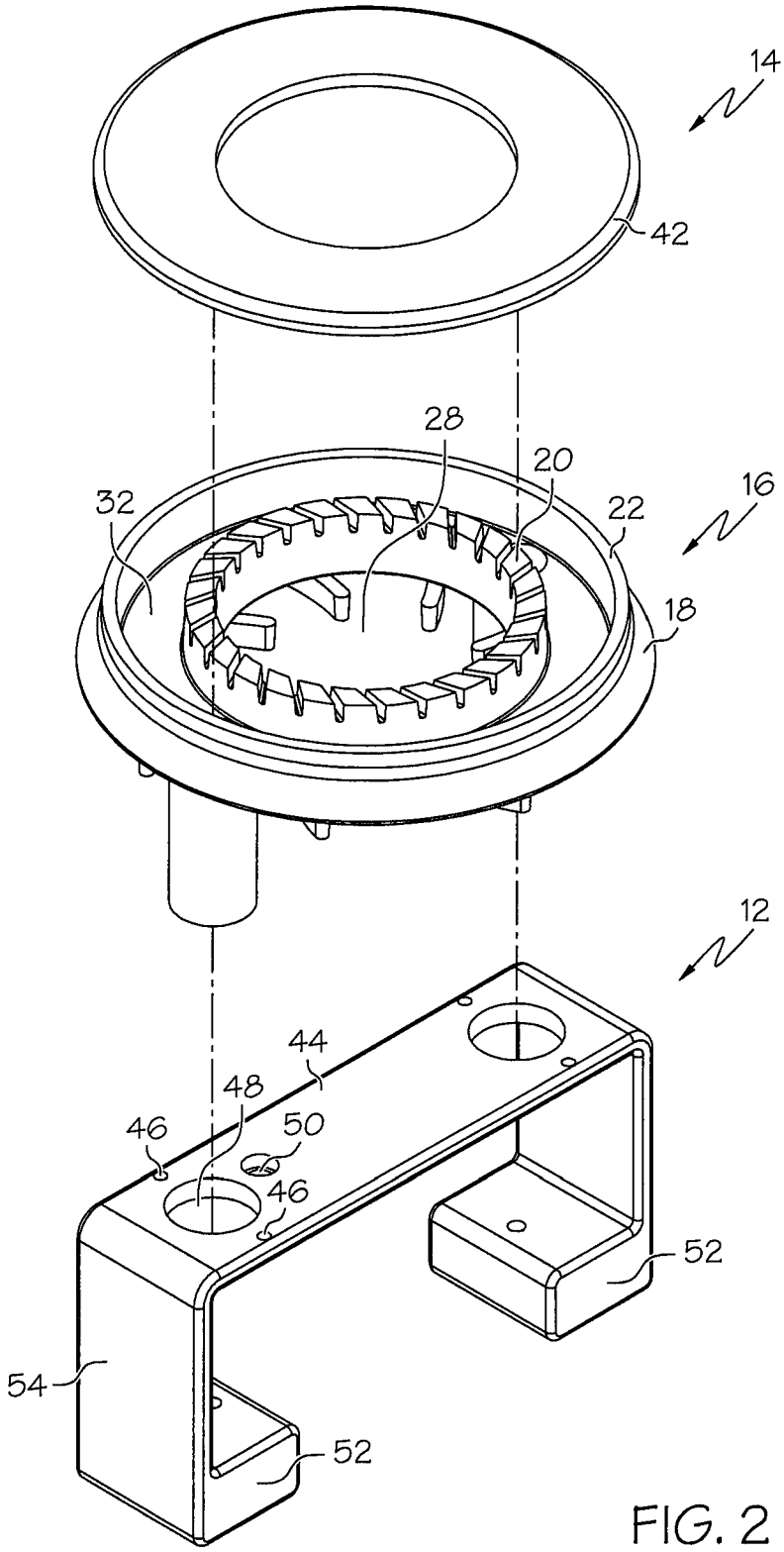
FIG. 2 provides an exploded top perspective view of the gas burner including a burner cap, a burner, and mounting base.
Figure 3:
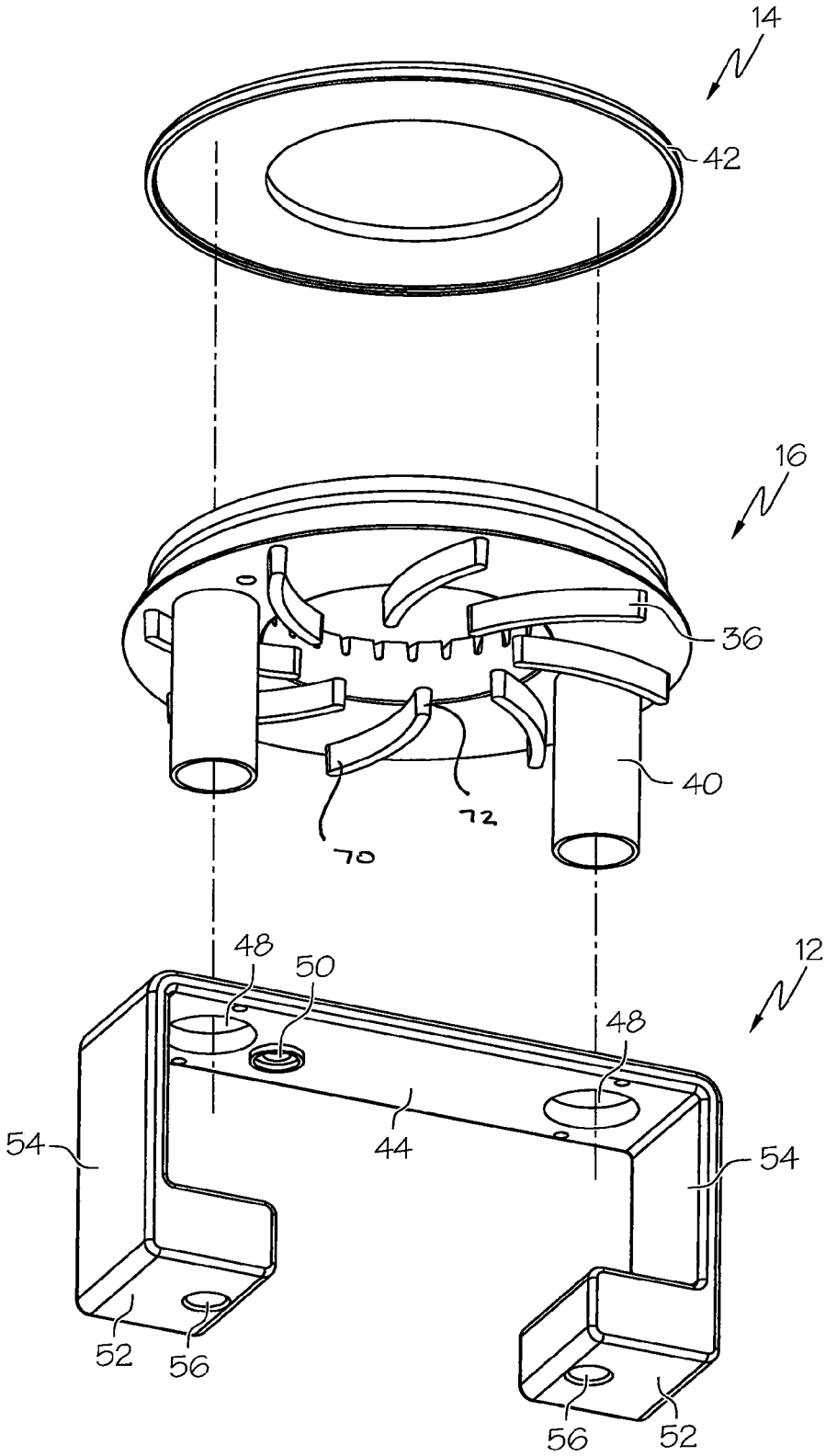
FIG. 3 provides an exploded bottom perspective view of the gas burner including a burner cap, a burner, and mounting base.

The gas burner 10 is shown in greater detail in FIG. 2, which provides an exploded top perspective view of the gas burner 10 including a burner cap 14, a burner 16, and a mounting base 12. A complementary view of the gas burner 10 is provided in FIG. 3, which shows an exploded bottom perspective view of the gas burner 10. The burner cap 14 rests on top of the burner 16 and both prevents loss of gaseous fuel from the top of the burner 16 and provides a closed, aesthetically appealing surface for the top of the burner 16 that deters spillage of food or liquids into the burner 16 itself.

Figure 4:
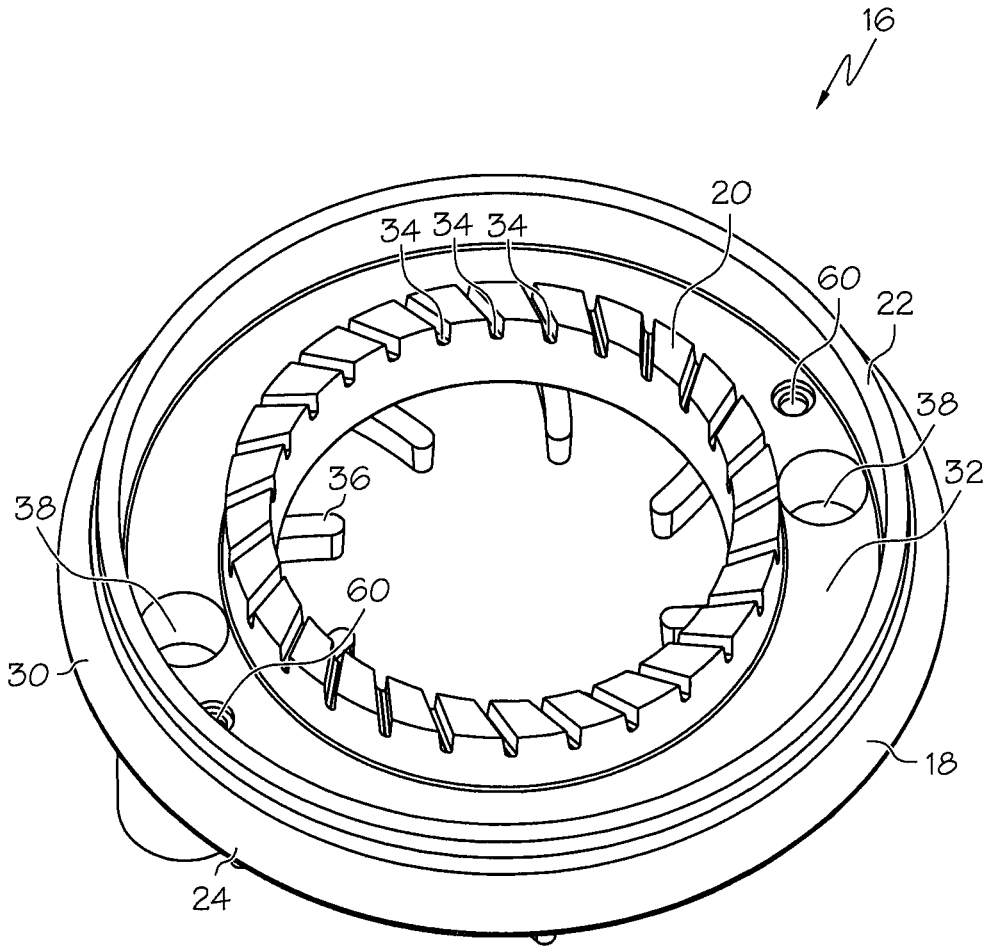
FIG. 4 provides a top perspective view of a burner with curved fuel exit ports and vanes forming portions of a spiral pattern.
Figure 5:
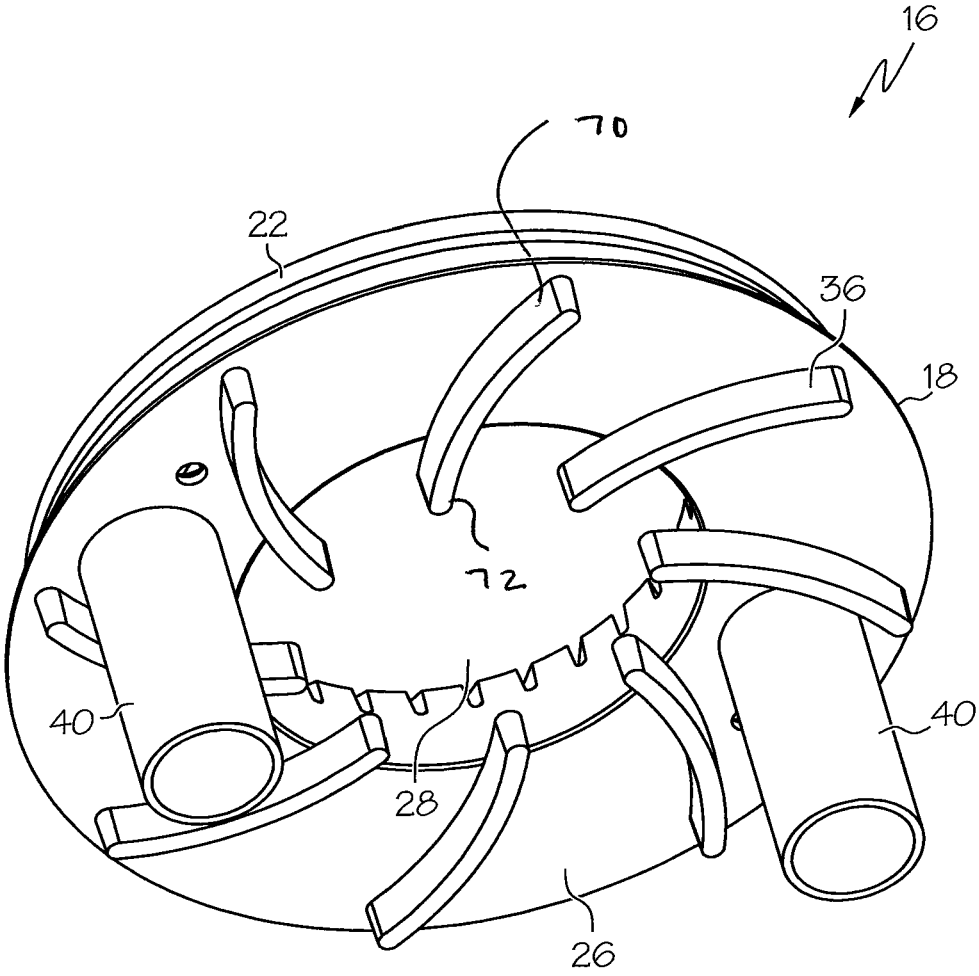
FIG. 5 provides a bottom perspective view of a burner with curved fuel exit ports and vanes forming portions of a spiral pattern.

The burner 16 is shown in greater detail in FIGS. 4 and 5, which show top and bottom perspective views, respectively, of an embodiment of the burner 16. The burner 16 includes a burner base 18, an inner wall 20, and an outer wall 22. The burner base 18 includes a first side 24 and a second side 26, which are the top and bottom sides, respectively, of the burner base 18 when oriented on a cooktop in the usual fashion. The burner base 18 also includes a combustion chamber 28, which is a hollow circular region within the center of the burner base 18 where gaseous fuel and air mix and combustion occurs. The burner base 18 is annular (e.g. washer-shaped). The second side 26 of the burner base 18 is generally flat. While the first side 24 of the burner base 18 can also be flat, in some embodiments the outer region 30 of the burner base 18 may be angled upwards by providing increased thickness on the side of the outer region 30 that is adjacent to the outer wall 22. Providing an angled outer region 30 can help direct airflow along the outside of the gas burner 10.

The burner base 18 can be fabricated from a variety of suitable materials such as carbon steel, brass, or aluminum, with aluminum being preferred. However, any other suitable material such as cast iron, ceramics, or even heat-resistant plastics can be used, so long as the material used is capable of withstanding the temperatures resulting from the operation of the burner for an extended period of time and over numerous thermal cycles. The burner base 18 can be fabricated using die casting or any other suitable method known to those skilled in the art.

The inner wall 20 is positioned on the first side 24 of the burner base 18 along the combustion chamber 28, and the outer wall 22 is positioned on the first side 24 of the burner base 18 outwards from the inner wall 20, forming an annular fuel/air channel 32 between the inner wall 20 and the outer wall 22. The inner wall 20 and the outer wall 22 thus provide a concentric ring structure or a "tube-in-tube" structure. The height of the inner wall 20 and the outer wall 22 should typically be the same so that the fuel/air channel 32 becomes closed upon placing the burner cap 14 upon the burner 16. However, the heights may differ if the burner cap 14 is designed to fit over walls having different heights while still closing off the fuel/air channel 32.

The inner wall 20 includes a plurality of fuel exit ports 34. The fuel exit ports 34 are apertures in the inner wall 20 that allow gaseous fuel within the fuel/air channel 32 to exit from the fuel/air channel 32 and enter the combustion chamber 28 where it mixes with air or any other suitable oxygen source. The number of fuel exit ports 34 can vary in different embodiments of the invention; however, sufficient fuel exit ports 34 should be provided to both encourage the even mixing of gaseous fuel with air and to allow sufficient gaseous fuel to enter the combustion chamber 28 to provide the desired level of heating. For example, about 20-30 fuel exit ports 34 can be used.

Figure 6:
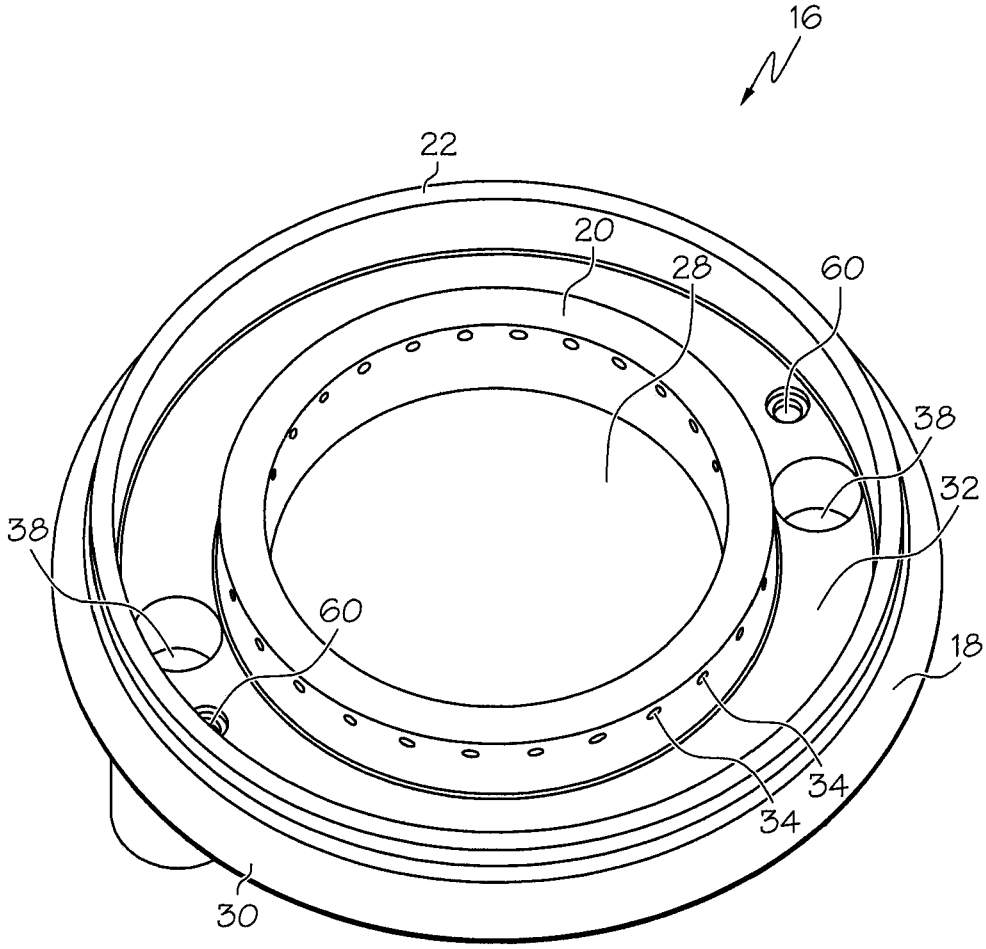
FIG. 6 provides a top perspective view of a burner with fuel exit ports that are straight channels.

The fuel exit ports 34 can be any passage that allows fuel to enter the combustion chamber 28 from the fuel/air channel 32. For example, the fuel exit ports 34 can be straight channels running through the inner wall 20 as shown in FIG. 6. Alternately, the fuel exit ports 34 can be aligned and angled relative to the center of the combustion chamber. By aligned, it is meant that the angled fuel exit ports 34 are all oriented in the same direction relative to the inner wall 20. For example, if one of the fuel exit ports 34 passes through the inner wall 20 at an angle of about 15 degrees in one direction, all of the fuel exit ports 34 will pass through the inner wall 20 at about 15 degrees in one direction. Angling the fuel exit ports 34 encourages the gaseous fuel to swirl upon entering the combustion chamber 28. The fuel exit ports 34 can be angled to a variety of different degrees relative to the center of the combustion chamber 28. For example, the fuel exit ports can be angled from about 10 degrees to about 75 degrees, or from about 20 degrees to about 55 degrees.

The fuel exit ports 34 can be provided in a variety of shapes. For example, the fuel exit ports 34 can be circular tunnels passing through the inner wall 20, as shown in FIG. 6. Another shape suitable for the fuel exit ports 34 are grooves positioned in the top region of the inner wall 20. The grooves are small channels that extend downward into a portion of the inner wall 20 from the top of the wall. Grooves provide the advantage of being somewhat easier to clean than other types of fuel exit ports if the burner 16 is removed from the cooking appliance, as they can be readily accessed by removing the burner cap 14. When a burner cap 14 is placed over the burner 16, the top of the grooves will be covered so that the grooves form tunnels that serve as fuel exit ports 34. The fuel exit ports 34 can vary in diameter in different embodiments of the invention, based on the desired level of gaseous fuel flow to the combustion chamber 28.

As noted herein, the fuel exit ports 34 can be angled so that the gaseous fuel entering the combustion chamber 28 will swirl. In some embodiments of the invention, the fuel exit ports 34 are also curved to form a portion of a spiral pattern (e.g., a logarithmic spiral). A spiral is a curve which emanates from a central point, getting progressively farther away as it revolves around the point. The angle of a curved fuel exit port 34 will vary as it passes through the inner wall 20. By a portion of a spiral, what is meant is that the fuel exit ports 34 in the inner wall 20 are curved so that a spiral having that angle of curvature could be overlaid on the curves present in the inner wall 20. Providing curved fuel exit ports 34 further helps to swirl the gaseous fuel when it enters the combustion chamber 28.

Figure 7:
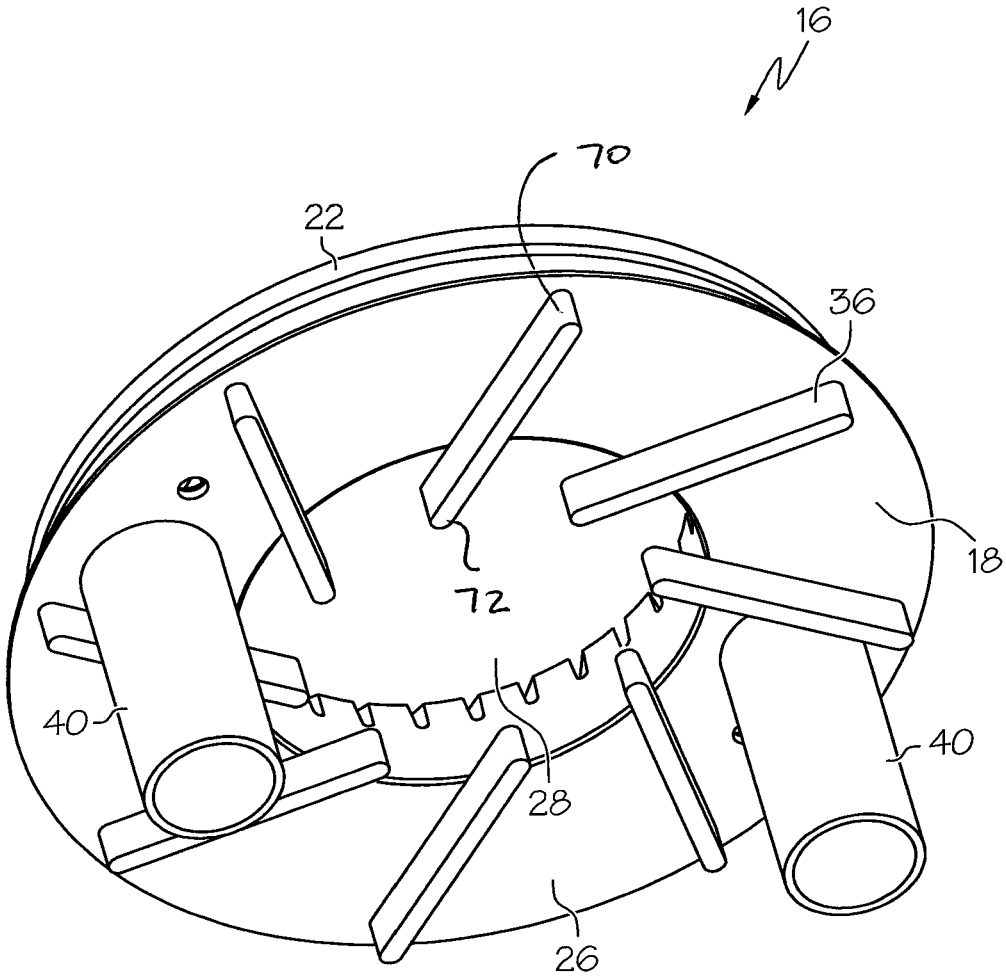
FIG. 7 provides a bottom perspective view of a burner with aligned and angled vanes.

The burner 16 also includes a plurality of vanes with a first end 70 and a second end 72, wherein the first end 70 is positioned on the second side 26 of the burner base 18 and the second end 72 extends beyond the inner wall 20 and adjacent to the combustion chamber 28, such that they extend into the space below the combustion chamber 28. The design of the vanes 36 is most readily appreciated through the embodiment shown in FIG. 5. The vanes 36 are designed to help impart a swirling motion on air as it enters the combustion chamber 28 where it mixes with the gaseous fuel that swirls into the combustion chamber 28 from the fuel exit ports 34. Air is drawn into the combustion chamber 28 by convection, as a result of the operation of the gas burner 10, which draws air from within the cooking appliance past the vanes 36. To encourage rather than disrupt the swirl resulting from angling the fuel exit ports 34, the vanes 36 are angled in the same direction as the fuel exit ports 34. However, angled or curved vanes 36 can also be used in embodiments in which the fuel exit ports 34 are not angled. A gas burner 10 including angled vanes 36 as shown in FIG. 7. The vanes 36 are angled in the same direction relative to the combustion chamber 28.

In some embodiments, such as that shown in FIGS. 4 and 5, the vanes 36 can also be curved to form a portion of a spiral, in the same manner as embodiments of the fuel exit ports 34. When curved to form a portion of a spiral, they will typically curve in about the same direction as the curve provided in the fuel exit ports 34. In addition to curving in the same direction, in some embodiments they may form a portion of the same spiral pattern. However, in some embodiments, only the vanes 36 or only the fuel exit ports 34 are curved, whereas the other component is merely angled.

The vanes 36 can have a variety of shapes that are suitable for redirecting airflow. For example, the vanes 36 can be oblong rectangular strips or beams as shown in FIGS. 4 and 5. The outer ends of the vanes 36 are attached to the second side 26 (i.e., the bottom) of the burner base 18, while the inner end of the vanes 36 extends into a portion of the space below the combustion chamber 28 and beyond the inner wall 20. The number of vanes 36 used can vary in different embodiments of the invention. For example, about 6-10 vanes can be used.

The burner 16 also includes one or more gas entry holes 38 in the annular fuel/air channel 32. The gas entry holes 38 are openings positioned within the fuel/air channel 32 that pass through the burner base 18 to allow gaseous fuel to enter the fuel/air channel 32. The gas entry holes 38 have a diameter sufficient to allow the ready passage of gaseous fuel into the fuel/air channel 32. For example, the gas entry holes 38 may have a diameter equal to the width of the fuel/air channel 32. The number and positioning of gas entry holes 38 can vary in different embodiments of the invention. For example, in one embodiment of the invention, there are two gas entry holes 38 positioned opposite from one another within the annular fuel/air channel 32.

The burner 16 also includes one or more gas entry tubes 40 positioned under the gas entry holes 38 and extending downward from the second side 26 of the burner base 18. The gas entry tubes 40 are conduits for gaseous fuel that are positioned underneath the gas entry holes 38 to channel gaseous fuel from gas lines to the fuel/air channel 32. The gas entry tubes 40 are thus required to be hollow structures that can transfer gaseous fuel. A variety of shapes can be used for the gas entry tubes 40. For example, they can be hollow cylinders as shown in the figures. The gas entry tubes 40 should have a length sufficient for the gas entry tubes 40 to extend beyond the vanes 36 so that they can extend into holes in the mounting base 12 when the burner 16 is positioned over the mounting base 12.

The gas burner 10 also includes an annular burner cap 14 configured to fit over the annular fuel/air channel 32. The burner cap 14 is typically washer-shaped, having an inner edge and an outer edge, both of which are circular, as shown in the figures, such that it fits over the inner wall 20 and the outer wall 22, while including a circular opening similar to that of the combustion chamber 28. The outer edge of the burner cap 14 can also include flange 42 that extends over the upper edge of the outer wall 22 to help retain the burner cap 14 in place over the burner 16. The burner cap 14 can be formed from any suitable material capable of withstanding the temperatures resulting from the operation of the burner 16 for an extended period of time and over numerous thermal cycles. For example, the burner cap 14 can be formed of steel, and prepared by stamping or sintering of metal powder. The burner cap 14 can simply rest upon the surface of the burner 16, or if desired it can be further secured by attachment.

The burner 16 can be mounted directly to the surface of a cooktop. If mounted in this fashion, gas lines will be installed such that they provide fuel to the burner 16 through the gas entry tubes 40. However, other embodiments the gas burner 10 is provided with a mounting base 12 to support the gas burner 10 on a cooking appliance. The mounting base 12 can provide various functions such as supporting the gas burner 10 above a surface within the heating region of a cooking appliance (e.g., a range cooktop), facilitating air entry into the gas burner 10, aligning the gas burner 10 with the one or more gas lines, and/or simplifying the removal of the burner 16 for cleaning. The mounting base 12 includes a securing plate 44 with a planar surface that supports the gas burner 10 and provides various attachment points 46 for attachment to the gas burner 10 and the cooking appliance. Typically, the mounting base 12 is attached under the surface of the cooktop using screws or other connecting devices that connect with one or more attachment points.

The securing plate 44 of the mounting base 12 also includes one or more gas tube apertures 48 positioned and sized to receive the gas entry tubes 40 of the burner 16. The gas tube apertures 48 have a shape corresponding to the shape of the gas entry tubes 40. For example, if the gas entry tubes 40 are cylinders, the gas tube apertures 48 will be circular holes. When the burner 16 is positioned on the mounting base 12, a portion of the ends of the gas entry tubes 40 rests within the gas tube apertures 48. The securing plate 44 can also include an igniter aperture 50 positioned and sized to retain an igniter (not shown) within the combustion chamber 28 of the burner 16. Gas burner igniters are known in the art; for example, various types of electronic ignition systems such as a spark ignition system can be used. The mounting base 12 can be formed of a suitable material such as aluminum, ceramic, or stainless steel, with aluminum being preferred, and can be formed by die casting, for example.

In the embodiment shown in the figures, the mounting base 12 is a substantially C-shaped structure including a securing plate 44 and two supporting brackets 52. The securing plate 44 and the supporting brackets 52 are positioned parallel to one another, and are connected by sidewalls 54. This embodiment of the mounting base 12 is designed for use with burners 16 that have two gas entry tubes 40. Accordingly, the mounting base 12 has two gas tube apertures 48 positioned in the securing plate 44 such that they are each aligned with a gas line entry port 56 in a supporting bracket 52. The gas line entry ports 56 run through the supporting bracket 52 and are designed to retain a gas line (not shown) in position where it can supply gaseous fuel to the gas entry tubes 40.

In the assembled state, the gas burner 10 is provided with gas flow that travels from the gas lines to the gas line entry ports 56, which provide gas to the gas entry tubes 40. The gas burner 10 can be adapted to work with a variety of gaseous fuels, such as natural gas and propane. The gaseous fuel flows into the fuel/air channel 32, and then from there it flows through the fuel exit ports 34 into the combustion chamber 28 where it is mixed with air and ignited. The fuel exit ports 34 are angled to impart a swirling motion to the gaseous fuel that can improve combustion efficiency. Combustion draws air in from around the perimeter of the burner 16. As air is drawn into the combustion chamber 28, it passes vanes 36 on the bottom of the burner 16 that impart a swirling motion to the air as well, so that both the gaseous fuel and the air are swirling in the same direction. The gas burner 10 can generally provide from about 9,000 to about 17,000 British thermal units (BTUs), and can provide heat to a cooking vessel positioned over the gas burner 10 with an efficiency of at least about 60%.

Figure 8:
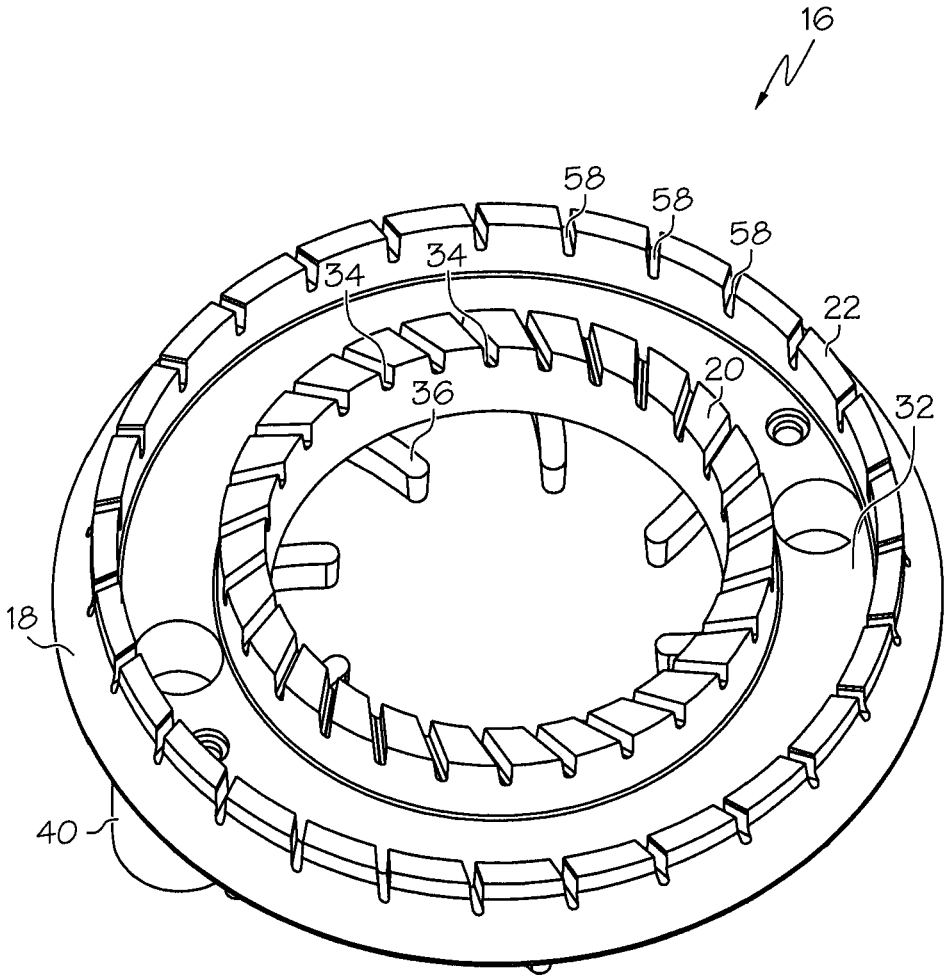
FIG. 8 provides a perspective view of a burner including external fuel ports.

The embodiment shown in FIGS. 1-5 includes fuel exit ports 34 only on the inner wall 20 of the burner 16. This configuration forms an "internal flame" during operation of the gas burner 10 in which the flames converge towards a central point. However, in some embodiments, it may also be desirable to provide external fuel ports 58 on the outer wall 22 of the burner 16. For example, FIG. 8 provides a perspective view of a burner 16 including external fuel ports 58 in addition to fuel exit ports 34. The external fuel ports 58 can be provided in a variety of shapes. For example, the external fuel ports 58 can be grooves positioned in the top region of the outer wall 22. The grooves are small channels that extend downward into a portion of the outer wall 22 from the top of the wall. External fuel ports 58 will be covered at the top by the burner plate 14 to form apertures through which gaseous fuel can flow. Providing external fuel ports 58 increases the amount of combustion and thus heat energy that the gas burner 10 can provide.

Figure 9:
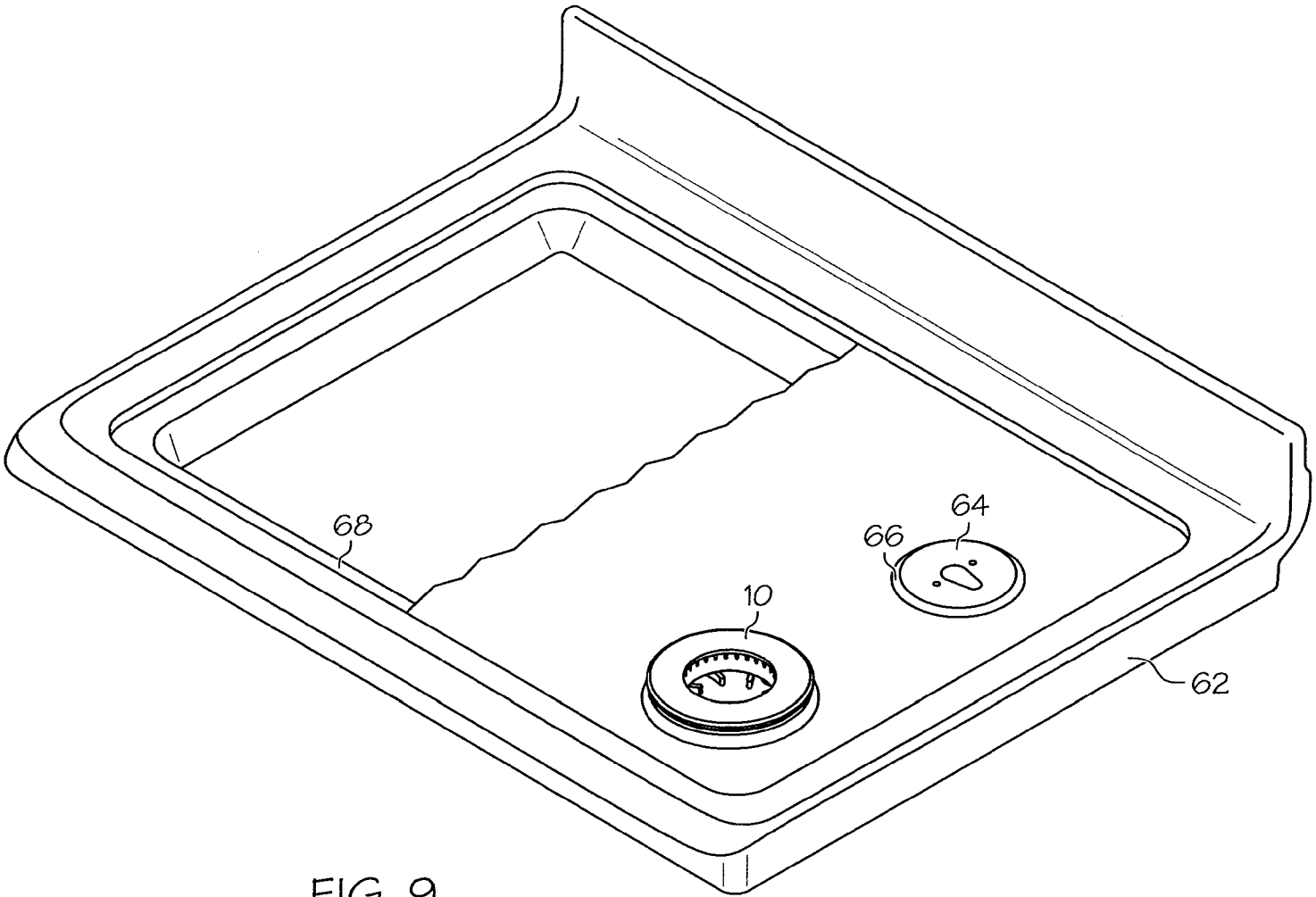
FIG. 9 provides a perspective view of a gas burner positioned on a stove top.

The gas burner 10 is generally provided on the surface of a cooking appliance. For example, FIG. 9 provides a perspective view of a stove top 62 that includes four gas burners 10 and a portion of a cooktop 68. As can be seen in the figure, in this embodiment the burner 16 and the burner cap 14 are positioned above the stove top 62, whereas the mounting base 12, which is not visible in FIG. 7, is attached below the stove top 62. The mounting base 12 is attached to the stove top 62 using screws or other connective devices that run through the attachment points 46 of the mounting base 12 and the base attachment holes 64 of the stove top 62. The stove top 62 can also include an, igniter access hole 66 to provide the igniter with access to the combustion chamber 28. A cooktop 68 can also be includes that rests on a portion of the stove top 62 that can include circular openings sized to accommodate the gas burners 10.

Embodiments of the gas burner 10 can provide improved aesthetics and avoid trapping spillage within the cooking appliance. For example, embodiments of the gas burner 10 can provide a burner system that provides no top surface openings that could allow spillage to drain through the gas burner 10 into the cooking appliance or burner components. The gas burner 10 is made resistant to spillage by providing a burner cap 14 that fits over the burner 16, resulting in a gas burner 10 that has no holes near the surface of the burner oriented in a direction that can trap spillage. This also improves the aesthetics of the cooking appliance by providing a gas burner 10 with a smooth uninterrupted surface.

Embodiments of the gas burner 10 can also provide a gas burner 10 that includes components that can be readily removed from the cooking appliance for cleaning. For example, the burner cap 14 can simply be lifted off of the burner 16 and cleaned. The burner 16 can also be easily removed from the mounting base 12 for cleaning. Cleaning can be carried out using typical kitchen materials, such as soap and water. The burner 16 can be mounted to the mounting base 12 by screw attachment in which one or more screws (not shown) are run through burner mounting holes 60 provided in the burner base 18 and into attachment points 46 provided in the mounting base 12. Thus, in order to remove the burner 16, one need only remove the screws used to attach the burner 16, which can then be lifted off of the cooking appliance and cleaned. Because the gas lines are attached to gas line entry ports 56, the burner 16 can be removed without disconnecting the gas lines.

Although only a few exemplary embodiments have been described in detail, those skilled in the art will readily appreciate that many modifications are possible in the exemplary embodiments without materially departing from the novel teachings and advantages of this disclosure. Accordingly, all such modifications and alternative are intended to be included within the scope of the invention as defined in the following claims. Those skilled in the art should also realize that such modifications and equivalent constructions or methods do not depart from the spirit and scope of the present disclosure, and that they may make various changes, substitutions, and alterations herein without departing from the spirit and scope of the present disclosure.

What is claimed is:

1. A gas burner for a cooking appliance comprising;

a burner comprising a burner base, an inner wall, and an outer wall, wherein the burner base comprises a first upper side, a second lower side, and a hollow circular combustion chamber in the center of the burner base, the inner wall being positioned on the first upper side of the burner base along the circular center region, and the outer wall being positioned on the first upper side of the burner base outwards from the inner wall, forming an annular fuel/air channel between the inner wall and the outer wall; a plurality of aligned angled fuel exit ports in the inner wall; and a plurality of vanes with a first end and a second end, angled in the same direction as the fuel exit ports, wherein the first end is attached directly to the second lower side of the burner base and the second end extends beyond the inner wall and adjacent to the combustion chamber to extend into a space below the combustion chamber, such that the combustion chamber is integral with the burner base, and the plurality of vanes are attached directly to the second lower side of the burner base, and further comprising one or more gas entry holes in the annular fuel/air channel, and one or more gas entry tubes connected to the gas entry holes and extending from the second lower side of the burner base, further comprising a mounting base with a planar surface including one or more gas tube apertures positioned and sized to receive the gas entry tubes, wherein the mounting base includes a securing plate and the one or more gas tube apertures are positioned in the securing plate such that they are each aligned with a gas line entry port in a support bracket, and wherein the burner is configured to be provided on an external surface of a cooking appliance and the mounting base is secured below said external surface of said cooking appliance.

2. The gas burner of claim 1, wherein the fuel exit ports are grooves in the top of the inner wall.

3. The gas burner of claim 1, wherein the fuel exit ports and the vanes are curved to form a portion of a spiral pattern.

4. The gas burner of claim 1, further comprising a plurality of fuel exit ports in the outer wall.

5. The gas burner of claim 1, wherein the one or more gas entry holes comprise two gas entry holes positioned opposite from one another within the annular fuel/air channel.

6. The gas burner of claim 1, wherein operation of the gas burner can provide heat to a cooking vessel positioned over the gas burner with an efficiency of at least 60%.

7. The gas burner of claim 1, further comprising an igniter aperture positioned and sized to retain an igniter within the combustion chamber of the burner.

8. The gas burner of claim 7, wherein the mounting base is a substantially C-shaped structure including the securing plate and two supporting brackets, wherein two gas tube apertures are positioned in the securing plate such that they are each aligned with a gas line entry port in said support bracket.

9. The gas burner of claim 1, further comprising a plurality of fuel exit ports in the outer wall that are not angled relative to a center of the combustion chamber.

10. A gas burner for a cooking appliance comprising;

a burner comprising a burner base, an inner wall, and an outer wall, wherein the burner base comprises a first upper side, a second lower side, and a hollow circular combustion chamber in the center of the burner base, the inner wall being positioned on the first upper side of the burner base along the combustion chamber, and the outer wall being positioned on the first upper side of the burner base outwards from the inner wall, forming an annular fuel/air channel between the inner wall and the outer wall; a plurality of angled fuel exit ports comprising grooves in the top of the inner wall that form a portion of a spiral pattern; a plurality of curved vanes with a first end and a second end that form a portion of a spiral pattern aligned with that created by the fuel exit ports, wherein the first end is attached directly to the second lower side of the burner base and the second end extends beyond the inner wall and adjacent to the combustion chamber to extend into a space below the combustion chamber, such that the combustion chamber is integral with the burner base, and the plurality of vanes are attached directly to the second lower side of the burner base; two gas entry holes positioned opposite from one another within the annular fuel/air channel, and two gas entry tubes connected to the gas entry holes and extending from the second lower side of the burner base, wherein the burner is configured to be provided on an external surface of a cooking appliance;

an annular burner cap configured to fit over the annular fuel/air channel; and a mounting base with a substantially C-shaped structure including a securing plate and two supporting brackets, wherein the securing plate comprises two gas tube apertures that are positioned and sized to receive the gas entry tubes and aligned with a gas line entry port in a support bracket and an igniter aperture positioned and sized to retain an igniter within the combustion chamber of the burner, and the mounting base is secured below said external surface of said cooking appliance.

11. The gas burner of claim 10, further comprising a plurality of fuel exit ports in the outer wall.

12. The gas burner of claim 10, wherein operation of the gas burner can provide heat to a cooking vessel positioned over the gas burner with an efficiency of at least 60%.

13. A gas burner for a cooking appliance comprising;

a burner comprising a burner base having a first upper side, a second lower side, and a hollow circular combustion chamber in the center of the burner base, a wall being positioned on the first upper side of the burner base, the wall having one or more fuel exit ports; and a plurality of vanes with a first end and a second end, angled in the same direction relative to the combustion chamber, wherein the first end is attached directly to the second lower side of the burner base and the second end extends beyond the wall and adjacent to the combustion chamber to extend into a space below the combustion chamber, such that the combustion chamber is integral with the burner base, and further comprising a mounting base with a planar surface including one or more gas tube apertures positioned and sized to receive gas entry tubes connected to one or more gas entry holes in an annular fuel/air channel of the burner, wherein the planar surface includes attachment points to thereby secure the burner to an external surface of a cooking appliance such that the burner is configured to be provided on said external surface of a cooking appliance, further comprising an igniter aperture positioned and sized to retain an igniter within the combustion chamber of the burner, and wherein the mounting base is a substantially C-shaped structure including a securing plate and two supporting brackets, wherein two gas tube apertures that are positioned in the securing plate such that they are each aligned with a gas line entry port in a support bracket.

14. The gas burner of claim 13, wherein the vanes are curved.

15. The gas burner of claim 14, wherein the vanes form a portion of a spiral pattern.

16. The gas burner of claim 14, wherein the vanes further comprise oblong rectangular strips.

* * * * *